US007245194B2

(12) United States Patent
Muto

(10) Patent No.: US 7,245,194 B2
(45) Date of Patent: Jul. 17, 2007

(54) RESONATOR AND DIELECTRIC FILTER

(75) Inventor: Akira Muto, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/950,721

(22) Filed: Sep. 27, 2004

(65) Prior Publication Data

US 2005/0068126 A1 Mar. 31, 2005

(30) Foreign Application Priority Data

Sep. 30, 2003 (JP) ..... 2003-341467

(51) Int. Cl.
*H01P 1/203* (2006.01)

(52) U.S. Cl. ..... 333/204; 333/175

(58) Field of Classification Search ..... 333/174, 333/175, 185, 204, 219
See application file for complete search history.

(56) References Cited

U.S. PATENT DOCUMENTS

| | | | | |
|---|---|---|---|---|
| 5,404,118 | A | 4/1995 | Okamura et al. | |
| 5,777,533 | A | 7/1998 | Kato et al. | |
| 6,417,745 | B1 | 7/2002 | Taniguchi | |
| 6,784,762 | B2 * | 8/2004 | Kato | 333/185 |
| 6,917,259 | B2 * | 7/2005 | Hirabayashi | 333/105 |
| 2002/0075106 | A1 * | 6/2002 | Okubora et al. | 333/247 |
| 2004/0036551 | A1 | 2/2004 | Hirabayashi | |
| 2004/0104792 | A1 * | 6/2004 | Kim et al. | 333/204 |

FOREIGN PATENT DOCUMENTS

| | | |
|---|---|---|
| JP | 04-078801 | 3/1992 |
| JP | 05-148005 | 6/1993 |
| JP | 05-191103 | 7/1993 |
| JP | 07-336104 | 12/1995 |
| JP | 10051203 A * | 2/1998 |
| JP | 10-075145 | 3/1998 |
| WO | WO03/026060 | 3/2003 |

* cited by examiner

*Primary Examiner*—Seungsook Ham
(74) *Attorney, Agent, or Firm*—Robert J. Depke; Rockey, Depke, Lyons & Kitzinger LLC

(57) ABSTRACT

One pair of resonant electrodes is formed in a loop shape or a spiral shape in a substrate stacking direction symmetrically to each other. This allows a longitudinal space in substrate to be reduced. A first capacitor having an electrode connected to the grounding conductor layer, an electrode connected to an open-end side of the resonant electrode, and a dielectric layer is provided. A second capacitor having an electrode connected to the grounding conductor layer, an electrode connected to an open-end side of the resonant electrode, and a dielectric layer is also provided. This results in having a desired characteristic even if a length of the resonant electrode is short.

11 Claims, 8 Drawing Sheets

RESONATOR AND DIELECTRIC FILTER

BACKGROUND THE INVENTION

1. Field of the Invention

The present invention relates to a resonator and a dielectric filter.

2. Description of the Related Art

As a communication system using a high-frequency radio wave in a microwave-band or a millimeter-wave band as a carrier, for example, a telephone system such as a cellular phone or a wireless local area network (LAN) has become widely used, it has become possible to transmit and receive a variety of types of data easily and not through a repeater etc., at a variety of places both indoors and outdoors.

An instrument used in such a communication system is provided with a filter element such as a low-pass filter (LPF), a high-pass filter (HPF), or band-pass filter (BPF). The filter element is designed so that it can be used in a distributed parameter circuit, not in a lumped parameter circuit, in order to process a signal in the high-frequency band. For example, a filter having a tri-plate structure is formed using a pair of parallel electric conductor patterns.

Further, to carry the instrument easily, an attempt has been made to miniaturize it by means of high-density packaging, multi-layering of its substrates, etc. For example, in configuring of pattern wiring line layers, dielectric insulating layers, etc. into a multi-layered structure, such layers in which filters, capacitors, inductors, registers, etc. are formed and pattern layers in which signal wiring lines, power supply lines, etc. are formed are configured into a multi-layer structure to provide a high-frequency module device in practice.

However, in the case of, for example, a comb-line type filter by which one pair of conductor patterns each having a length that is one fourth a wavelength of a signal to be transmitted therethrough is coupled to each other electromagnetically, if the signal to be transmitted has a low frequency, the conductor patterns must be elongated, to make it impossible to miniaturize the filter.

Furthermore, if an instrument is miniaturized by configuring into a multi-layer structure such layers as filter layers designed as those of a distributed parameter circuit and pattern wiring line layers, behaviors of the filter are influenced by signal wiring line patterns etc, thus making it impossible to obtain desired filter characteristics in some cases. For example, if a signal wiring line pattern is arranged between a grounding conductor layer and conductor patterns, a condition of electromagnetic coupling between one pair of parallel conductor patterns changes, thereby making it impossible to obtain desired filter characteristics in some cases.

SUMMARY OF THE INVENTION

It is an object of the present invention to provide a resonator and a dielectric filter which can be reduced in size and costs and have desired characteristics with a high accuracy and a suppressed loss.

In order to attain the above object, as an aspect of the present invention, there provides a resonator comprising a stack substrate obtained by stacking multiple layers of dielectric material and conductive material. The stack substrate includes a grounding conductor layer formed on one side of the stack substrate. The stack substrate also includes a resonant-pattern conductor layer having one pair of resonant electrodes each having one end as a short-circuiting end connected to the grounding conductor layer and the other end as an open end. The resonant-pattern conductor layer is provided opposite the grounding conductor layer via the dielectric layer, to use the open-end side of one of the resonant electrodes as a signal input terminal and the open-end side of the other resonant electrode as a signal output terminal. The one pair of resonant electrodes is formed symmetrically to each other in a loop shape or a spiral shape in a substrate stacking direction.

As another aspect of the present invention, there provides a dielectric filter for allowing, within a signal input to a signal input terminal, a desired frequency band to be transmitted and output from a signal output terminal. The dielectric filter comprises a stack substrate obtained by stacking multiple layers of dielectric material and conductive material. The stack substrate includes a grounding conductor layer formed on one side of the stack substrate. The stack substrate also includes a resonant-pattern conductor layer having one pair of resonant electrodes each having one end as a short-circuiting end connected to the grounding conductor layer and the other end as an open end. The resonant-pattern conductor layer is provided opposite the grounding conductor layer via the layer of dielectric material, to use the open-end side of one of the resonant electrodes as the signal input terminal and the open-end side of the other resonant electrode as the signal output terminal. The one pair of resonant electrodes is formed symmetrically to each other in a loop shape or a spiral shape in a substrate stacking direction.

In the present invention, one pair of resonant electrodes is formed in a loop shape or a spiral shape in a substrate stacking direction symmetrically to each other with respect to, for example, a gap between the resonant electrodes. Further, a first capacitor having such a stack construction that its one end is connected to the grounding conductor layer and the other end of it is connected to the signal input terminal or the resonant electrode whose open-end side is used as the signal input terminal is formed using, for example, tantalum oxide. A second capacitor having such a stack construction that its one end is connected to the grounding conductor layer and the other end of it is connected to the signal output terminal or the resonant electrode whose open-end side is used as the signal output terminal is formed using, for example, tantalum oxide. A third capacitor having such a stack construction that its one end is connected to the signal input terminal or the resonant electrode whose open-end side is used as the signal input terminal and the other end of it is connected to the signal output terminal or the resonant electrode whose the open-end side is used as the signal output terminal is formed using, for example, tantalum oxide. Furthermore, in a layer of conductive material arranged between the grounding conductor layer and the resonant-pattern conductor layer, a slot is formed in such a manner as to contain a region that faces the resonant electrodes.

According to the present invention, one pair of resonant electrodes is formed in a loop shape or a spiral shape in a substrate stacking direction symmetrically to each other. This allows a longitudinal space in substrate to be reduced, thereby miniaturizing the resonator and the dielectric filter. The first capacitor having one end connected to the grounding conductor layer and the other end connected to the signal input terminal or the resonant electrode whose open-end side is used as the signal input terminal, and the second capacitor having one end connected to the grounding conductor layer and the other end connected to the signal output terminal or the resonant electrode whose open-end side is used as the signal output terminal, are provided so that the resonant electrode may be further reduced, thereby reducing the instrument in size. Further, the third capacitor having one end connected to the signal input terminal or the resonant electrode whose open-end side is used as the signal input terminal and the other end connected to the signal output terminal or the resonant electrode whose open-end side is used as the signal output terminal is provided. This allows a trapped frequency to be adjusted, by adjusting static capacitance of the third capacitor. Additionally, using tantalum oxide as dielectric material causes an area occupied by the capacitor on the substrate to be reduced, thereby reducing the instrument in size. Since the layer of conductive material arranged between the grounding conductor layer and the resonant-pattern conductor layer includes a slot so that it may contain a region facing the resonant electrodes, the resonator or the dielectric filter having a desired characteristic may be obtained without receiving any influence from other signal pattern wiring line, The concluding portion of this specification particularly points out and directly claims the subject matter of the present invention. However those skill in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

Figure 1:
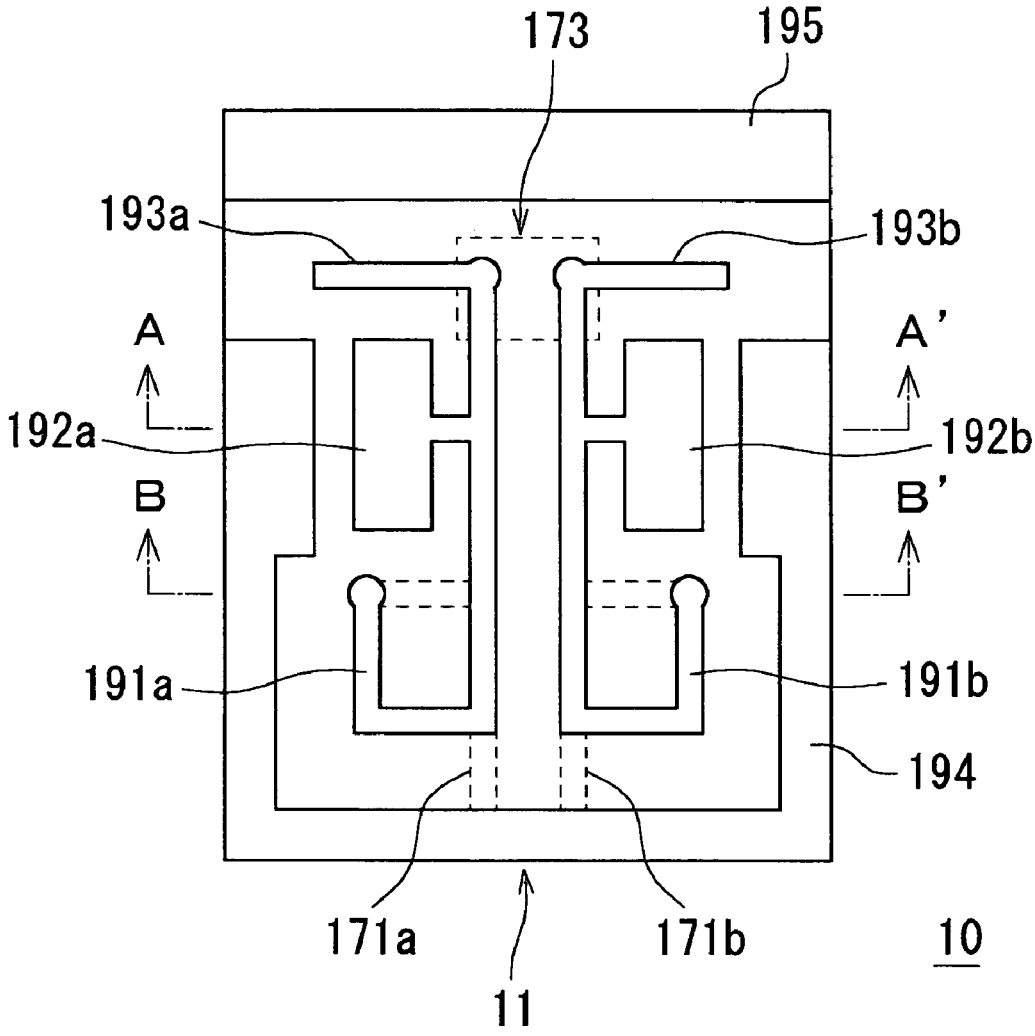
FIG. 1 is a diagram showing a configuration of a dielectric filter.
Figure 2:
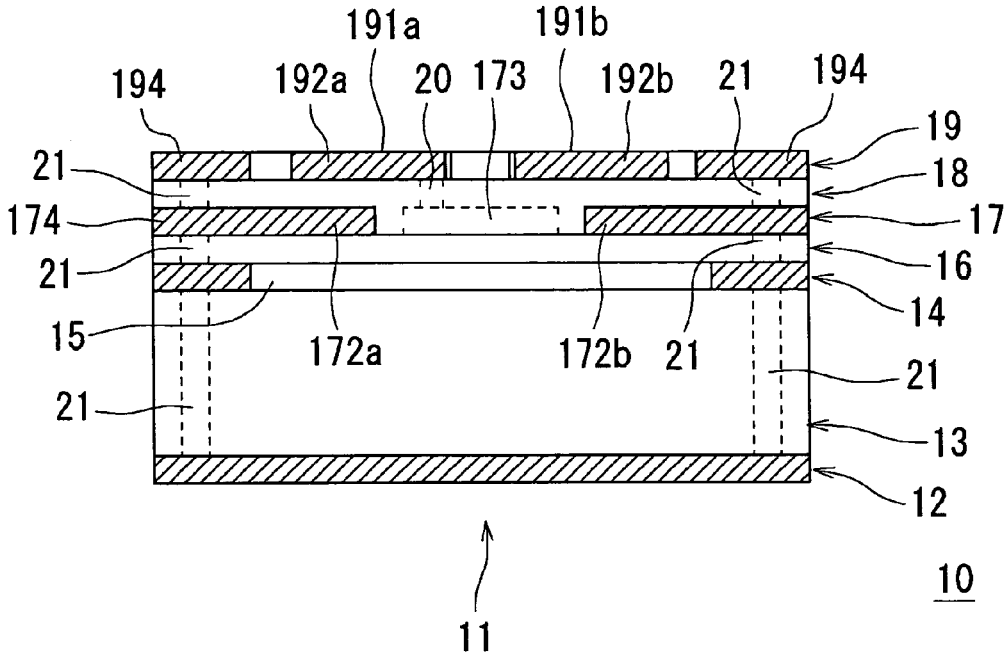
FIG. 2 is an outlined cross-sectional view (taken along line A–A' in FIG. 1) of the dielectric filter.
Figure 3:
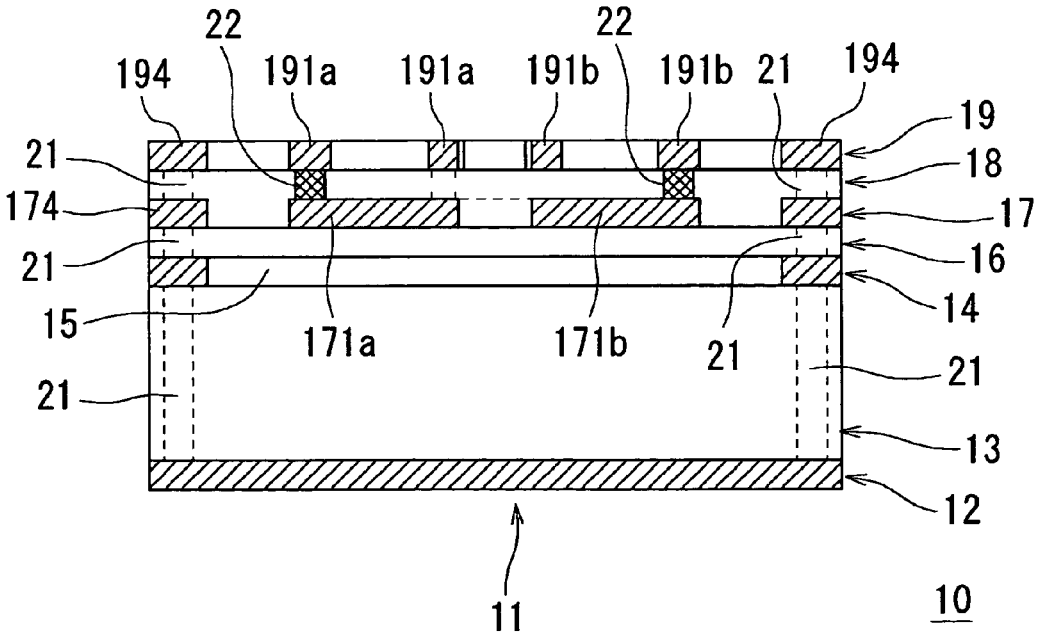
FIG. 3 is an outlined cross-sectional view (taken along line B–B' in FIG. 1) of the dielectric filter.
Figure 4:
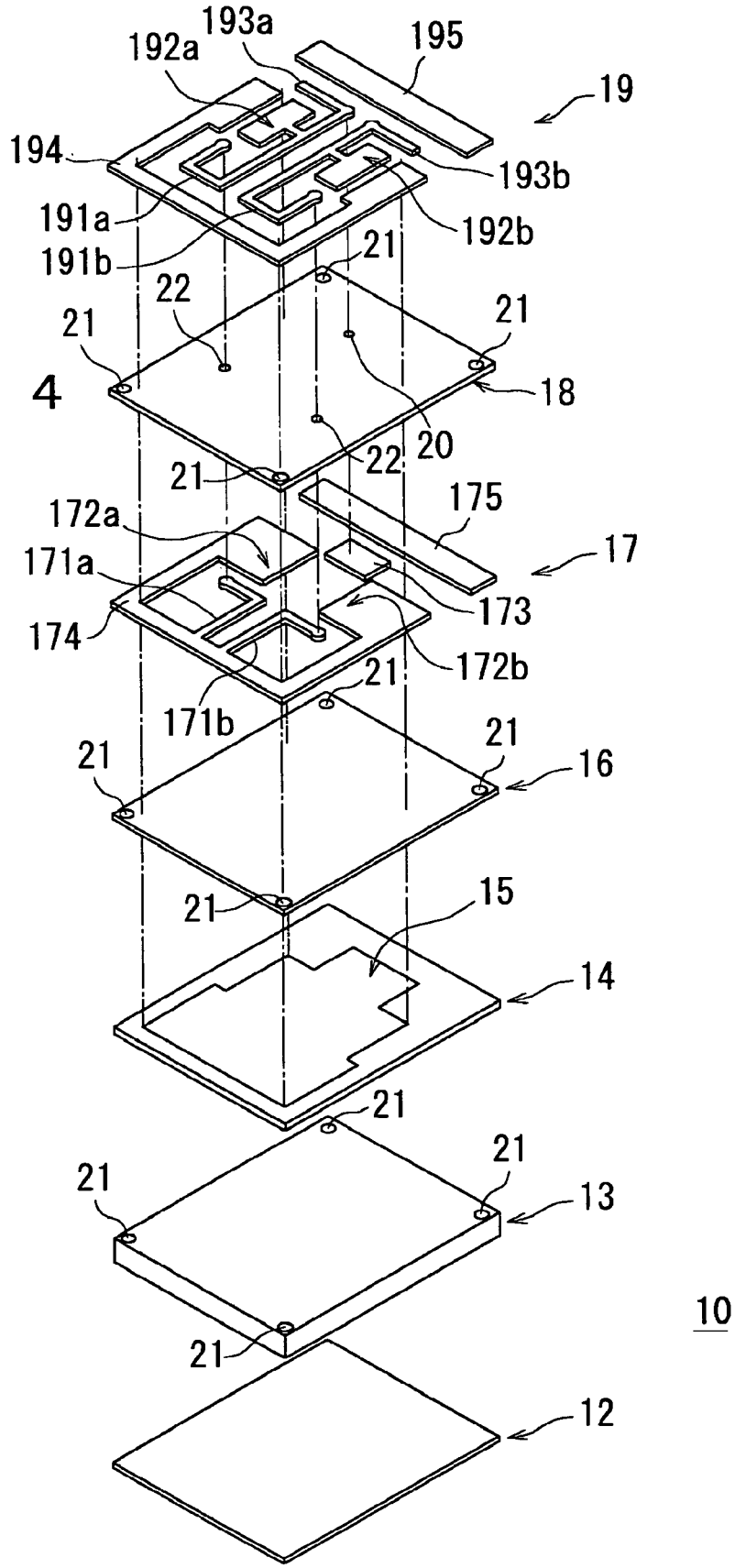
FIG. 4 is an exploded perspective view of the dielectric filter.

The following will describe embodiments of the present invention with reference to drawings. FIG. 1 is a plan view of a configuration of a dielectric filter 10. FIG. 2 is a cross-sectional view of the dielectric filter 10 taken along line A–A' in FIG. 1. FIG. 3 is a cross-sectional view of the dielectric filter 10 taken along line B–B' in FIG. 1. FIG. 4 is an exploded perspective view of the dielectric filter 10. FIGS. 1–4 show the dielectric filter 10 in a condition where one pair of resonant electrodes is formed symmetrically to each other in a spiral shape in a substrate stacking direction.

On a rear side of a stack substrate 11 in which multiple layers of dielectric material (hereinafter referred to as "dielectric layer") and conductive material (hereinafter referred to as "conductor layer") are stacked, a first conductor layer 12 is formed as a grounding conductor layer. On, for example, the right layer side of the stack substrate 11 opposite the first conductor layer 12 via the dielectric layer, such a fourth conductor layer 19 is formed opposite the first conductor layer 12 as to comprise a conductor pattern having a resonant electrode 191*a*, a capacitor electrode 192*a*, and a signal input terminal 193*a*, a conductor pattern having a resonant electrode 191*b*, a capacitor electrode 192*b*, and a signal output terminal 193*b*, and a conductor pattern to provide grounding electrodes 194 and 195.

The resonant electrodes 191*a* and 191*b* each have a U-shape and are formed roughly parallel to each other with a predetermined distance in-between. One end of the resonant electrode 191*a* is connected to a resonant electrode 171*a* described later and the other end of it is open. On the side of the open end of this resonant electrode 191*a*, the signal input terminal 193*a* is provided roughly perpendicular to the resonant electrode 191*a*. Further, one end of the resonant electrode 191*b* is connected to a resonant electrode 171*b* described later and the other end of it is open. On the side of the open end of the resonant electrode 191*b*, the signal output terminal 193*b* is provided roughly perpendicular to the resonant electrode 191*b*.

On a side opposite the resonant electrode 191*b* with respect to the resonant electrode 191*a*, the capacitor electrode 192*a* is formed in such a manner as to protrude from the resonant electrode 191*a*. Further, on a side opposite the resonant electrode 191*a* with respect to the resonant electrode 191*b*, the capacitor electrode 192*b* is formed in such a manner as to protrude from the resonant electrode 191*b*. Furthermore, a third conductor layer 17 is provided opposite the fourth conductor layer 19 via a fourth dielectric layer 18 in-between in parallel condition. This third conductor layer 17 comprises a conductor pattern in which resonant electrodes 171*a* and 171*b* and capacitor electrodes 172*a* and 172*b* are connected to a grounding electrode 174, a conductor pattern which provides a capacitor electrode 173, and a conductor pattern which provides a grounding electrode 175. That is, in the dielectric filter 10 shown in FIGS. 1–4, the third conductor layer 17 and the fourth conductor layer 19 constitute a resonant pattern conductor layer.

The resonant electrodes 171*a* and 171*b* each have an L-shape and are formed roughly parallel to each other with a predetermined distance in-between. One end of the resonant electrode 171*a* is connected to the above-mentioned resonant electrode 191*a* and the other end of it is connected to the grounding electrode 174. On the other hand, one end of the resonant electrode 171*b* is connected to the above-mentioned resonant electrode 191*b* and the other end of it is connected to the grounding electrode 174. By thus connecting the resonant electrodes 171*a* and 171*b* and the resonant electrodes 191*a* and 191*b*, it is possible to form resonant electrodes in a spiral shape in the substrate stacking direction. It is to be noted that the shapes of the resonant electrodes 171*a* and 171*b* and those of the resonant electrodes 191*a* and 191*b* are not limited to those shown in FIGS. 1–4 as far as a spiral shape can be formed in the substrate stacking direction by connecting the resonant electrodes 171*a* and 171*b* and the resonant electrodes 191*a* and 191*b*. For example, the resonant electrodes 171*a* and 171*b* may be U-shaped and the resonant electrodes 191*a* and 191*b* may be L-shaped.

The capacitor electrode 172*a* is formed in such a manner as to be opposite the capacitor electrode 192*a*. This capacitor electrode 192*a*, the fourth dielectric layer 18, and the capacitor electrode 172*a* constitute a capacitor C1. Further, the capacitor electrode 172*b* is formed in such a manner as to be opposite the capacitor electrode 192*b*. This capacitor electrode 192*b*, the fourth dielectric layer 18, and the capacitor electrode 172*b* constitute a capacitor C2. Furthermore, the grounding electrode 174 has a shape similar to the grounding electrode 194 so that a region that faces the resonant electrodes 171*a*, 171*b*, 191*a*, and 191*b* may be a slot.

The resonant electrode 191*a* is connected to the capacitor electrode 173 through a conductor-layer connecting portion (hereinafter referred to as "via" simply) 20 such as a via hole or a through hole. The capacitor electrode 173 is formed so as to be parallel to and opposite a pattern face of the resonant electrode 191*b* via the fourth dielectric layer 18 made of a dielectric material in-between, thus being combined with the capacitor electrode 173 and the resonant electrode 191*b* to constitute a capacitor C3. Further, through a via 21, the first conductor layer 12, the grounding electrodes 174, 175, 194, and 195, and a second conductor layer 14 are made conductive to each other.

A first dielectric layer 13 provides a base for the stack substrate 11 and has the first conductor layer 12 formed on one side of the first dielectric layer 13 and a second conductor layer 14 formed on the other side. In the second conductor layer 14, a slot is formed in such a manner as to contain a region that faces the resonant electrodes 191*a* and 191*b*, in which slot a second dielectric layer 15 is provided.

By thus providing the slot, there exists no other conductor layer between the first conductor layer 12 and the resonant electrodes 171*a*, 171*b*, 191*a*, and 191*b*, so that a condition of electromagnetic coupling between the resonant electrodes 171*a* and 191*a* and the resonant electrodes 171*b* and 191*b* is not changed by the other conductor layers.

Figure 5:
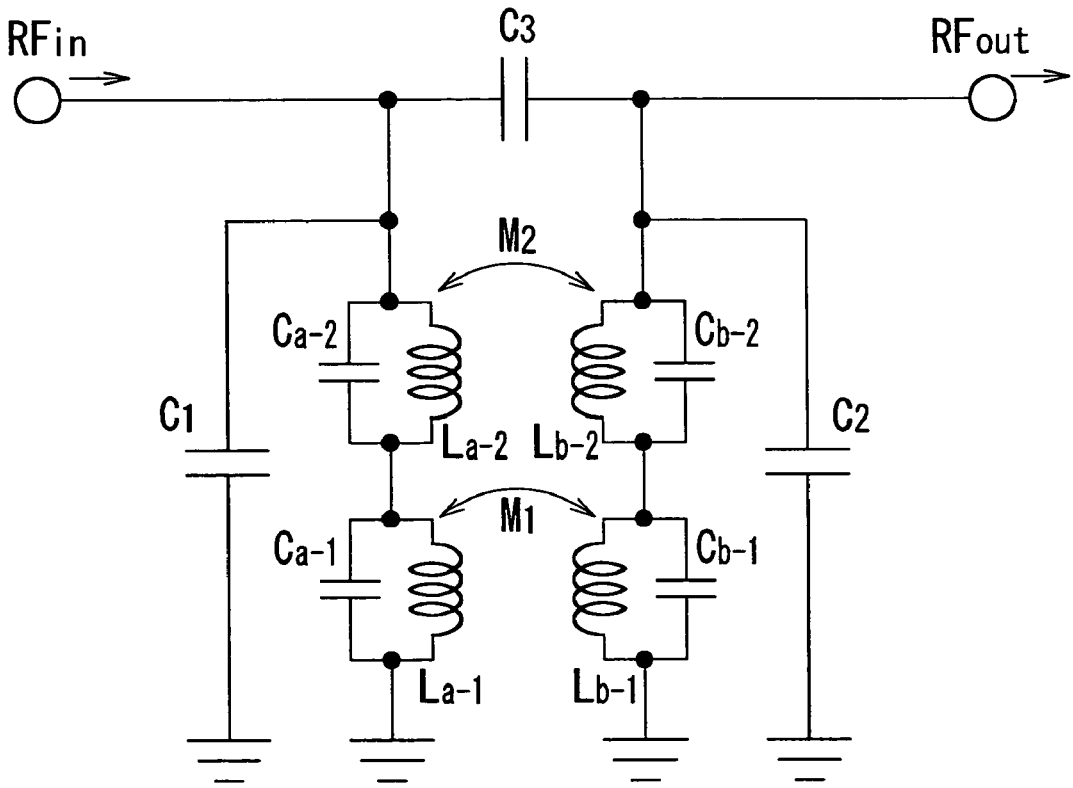
FIG. 5 is a diagram showing an equivalent circuit diagram of the dielectric filter.

FIG. 5 shows an equivalent circuit diagram of the dielectric filter 10. In this dielectric filter 10, a parallel circuit composed of inductance La-1 and stray capacitance Ca-1 of the resonant electrode 171*a* and a parallel circuit composed of inductance La-2 and stray capacitance Ca-2 of the resonant electrode 191*a* are connected in series and, to this series-connected circuit, the capacitor C1 is connected in parallel. Further, a parallel circuit composed of inductance Lb-1 and stray capacitance Cb-1 of the resonant electrode 171*b* and a parallel circuit composed of inductance Lb-2 and stray capacitance Cb-2 of the resonant electrode 191*b* are connected in series and, to this series-connected circuit, the capacitor C2 is connected in parallel. A circuit to which the capacitor C1 is connected in parallel and that to which the capacitor C2 is connected in parallel are shown as being capacitive-coupled to each other via the capacitor C3. Further, the resonant electrodes 171*a* and 171*b* are electromagnetically coupled to each other and the resonant electrodes 191*a* and 191*b* and the resonant electrodes 191*a* and 191*b* are electromagnetically coupled to each other. It is to be noted that M1 and M2 each indicate mutual inductance.

Therefore, by adjusting a length of a portion along which the resonant electrodes 171*a* and 171*b* are adjacently opposed to each other, a length of a portion along which the resonant electrodes 191*a* and 191*b* are adjacently opposed to each other, and capacitances of the capacitors C1, C2, and C3, a high-frequency signal RFin, when input from the signal input terminal 193*a*, can be filtered to obtain at the signal output terminal 193*b* a signal transmitted through a desired frequency band.

According to this dielectric filter, if static capacitance of the capacitors C1 and C2 is increased, a resonant frequency of a resonator constituted of the resonant electrodes 191*a* and 191*b* can be shifted to a lower-frequency side. That is, a pass-band of the dielectric filter can be shifted to a lower-frequency side. If the capacitance of the capacitors C1 and C2 is decreased, on the other hand, the resonant frequency can be shifted to a higher-frequency side. That is, the pass-band of the dielectric filter can be shifted to the higher-frequency side.

Furthermore, the capacitor C3 has a function as a trap, so that if capacitance of the capacitor C3 is increased, a frequency to be trapped (notch point) can be shifted to a lower-frequency side, and if the capacitance of the capacitor C3 is decreased, the notch point can be shifted to a higher-frequency side. Furthermore, since the resonant electrodes are formed in a spiral shape in the substrate stacking direction, a portion along which the resonant electrodes are adjacently opposed to each other is elongated without elongating the resonant electrode longitudinally, thus decreasing the resonant frequency.

The following will describe a procedure for generating a dielectric filter with reference to the exploded perspective view shown in FIG. 4. A dielectric filter uses a so-called printed wiring assembly as a base substrate. For example, a printed wiring assembly in which a dielectric substrate has a conductor layer formed on both sides is used as a base substrate.

One of the conductor layers on the base substrate is referred to as the first conductor layer 12 and the other conductor layer is referred to as the second conductor layer 14. These first conductor layer 12 and second conductor layer 14 are electrically connected to each other via the via 21 made of, for example, copper. The via 21 is formed by making at a portion of the dielectric substrate an opening that passes through this dielectric substrate by drilling, laser beam machining, plasma etching, etc. By performing via plating, for example, electrolytic plating by use of a copper sulfate solution on this opening, the via can be formed.

The dielectric substrate corresponds to the first dielectric layer 13 and preferably is made of a material that has a small dielectric loss (low-tan δ), that is, a material excellent in high-frequency response. Such materials include, for example, an organic material such as poly-phenyl ethylene (PPE), bismuleid triazine (BT-resin), poly-tetrafluoroethylene, polyimide, liquid-crystal polymer (LCP), poly-norbornene (PNB), or ceramic, and a mixed material between ceramic and an organic material. Further, preferably the first dielectric layer 13 is made of, besides the these materials, a material having heat resistance and chemical resistance; a dielectric substrate made of such a material may include an inexpensive epoxy-made substrate FR-5 etc. By using such an inexpensive organic material as the first dielectric layer 13, costs are reduced as compared to a case where a relatively expensive silicon substrate or glass substrate is used conventionally.

In the second conductor layer 14, a slot is formed in such a manner as to contain a region that faces the resonant electrodes 191*a* and 191*b*. A conductor on the slot portion is removed by, for example, etching.

On the second conductor layer 14 in which the slot is formed, an insulator film made of an insulating material having a high dielectric constant, for example, epoxy-based resin is formed. It is to be noted that the insulator film may be formed on both sides of the base substrate. In this case, the first conductor layer 12 can be protected by the insulator film formed on the first conductor layer 12. After the insulator film is formed, such a portion of the insulator film as to be on the second conductor layer 14 is polished off until the second conductor layer 14 is exposed. It is thus possible to form the second dielectric layer 15 and eliminate a step between the second conductor layer 14 and the second dielectric layer 15, thereby forming a flat surface used as a built-up surface.

On the built-up surface, a third dielectric layer 16 is stacked, on which third dielectric layer 16 a capacitor or a resonant electrode is formed using a thin film formation technology or a thick film formation technology. Preferably this third dielectric layer 16 is made of a material having a low dielectric loss (low tan δ), that is, an organic material excellent in high-frequency response or an organic material having heat resistance or chemical resistance. Such an organic material may include, for example, benzocyc butene (PCB), polyimide, poly norbornen (PNB), liquid crystal polymer (LCP), epoxy resin, acrylic resin, etc. The third dielectric layer 16 can be stacked by forming such an organic material accurately on the built-up surface by using a method excellent in application uniformity and film-thickness control such as, for example, spin coating, curtain coating, roll coating, or dip coating.

Next, on the third dielectric layer 16, a conductor film made of, for example, nickel or copper is formed throughout the surface and, then, using a photolithographic technology, a conductor pattern for the third conductor layer 17 is formed. That is, by using as a mask a photo-resist patterned into a predetermined shape, this conductor film is etched to form a conductor pattern in which the resonant electrodes 171*a* and 171*b* and the capacitor electrodes 172*a* and 172*b* are connected to the grounding electrode 174, a conductor pattern which provides the capacitor electrode 173, and a conductor pattern which provides the grounding electrode 175. For example, a conductor film constituted of a copper film having a thickness of about several micrometers is formed by electrolytic plating by use of, for example, a copper sulfate solution and etched to form the resonant electrodes 171*a* and 171*b*, the capacitor electrodes 172*a*, 172*b*, and 173, and the grounding electrodes 174 and 175. Further, a via 21 is formed in the third dielectric layer 16 to connect the second conductor layer 14 and the grounding electrodes 174 and 175 to each other.

On the third dielectric layer 16 on which the resonant electrodes 171*a* and 171*b*, the capacitor electrodes 172*a*, 172*b*, and 173, and the grounding electrodes 174 and 175 are formed, the fourth dielectric layer 18 made of the above-mentioned organic material is formed, on which a conductor film made of, for example, nickel or copper or the like is formed throughout the surface. Then, the photolithographic technology is used as described above to form the resonant electrodes 191*a* and 191*b*, the capacitor electrodes 192*a* and 192*b*, the signal input terminal 193*a*, the signal output terminal 193*b*, and the grounding electrodes 194 and 195. Further, the vias 21 and 22 are formed in the fourth dielectric layer 18, through the via 21 of which the grounding electrode 174 for the third conductor layer 17 and the grounding electrode 194 for the fourth conductor layer 19 are connected to each other and the grounding electrode 175 for the third conductor layer 17 and the grounding electrode 195 for the fourth conductor layer 19 are connected to each other. Further, through the via 22, the resonant electrodes 171*a* and 191*a* are connected to each other and the resonant electrodes 171*b* and 191*b* are connected to each other.

By thus using the thin-film patterning technology, it is possible to reduce a width of the wiring lines of the resonant electrodes and spacing between the wiring lines than conventional ones. For example, by reducing the thickness of the electrodes or the dielectric layers to about 10–30 μm, it is possible to reduce the width of the resonant electrode wiring lines to 5–20 μm and the spacing between the resonant electrodes to 5–20 μm. Accordingly, self-inductance or mutual inductance M of the resonator can be increased to make the resonant electrode wiring line short. That is, the dielectric filter can be miniaturized. Further, a capacitor is added between the resonant electrode and the grounding electrode, so that by adjusting static capacitance of this capacitor, the pass-band can be controlled to a desired frequency band. Furthermore, a trap can be provided by adjusting a capacitor arranged between the resonant electrodes, thereby adjusting a band of frequencies to be blocked for the dielectric filter.

Further, since the stack substrate is constituted of a thin film, the dielectric filter can also be thinned. For example, a base substrate having a thickness of about 200–800 μm is used to form a built-up surface on it. On this built-up surface, a conductor layer and a dielectric layer can be stacked to thereby form a stack substrate with a thickness of about 10–30 μm on which resonant electrodes and capacitors are formed, thereby constituting a thinned dielectric filter.

Further, by forming the resonant electrodes in a spiral shape in the substrate stacking direction, the portion along which they are adjacently opposed to each other can be elongated, so that it is possible to provide a dielectric filter having a low pass-band frequency without increasing a longitudinal size of the resonant electrodes in the dielectric filter.

Figure 6:
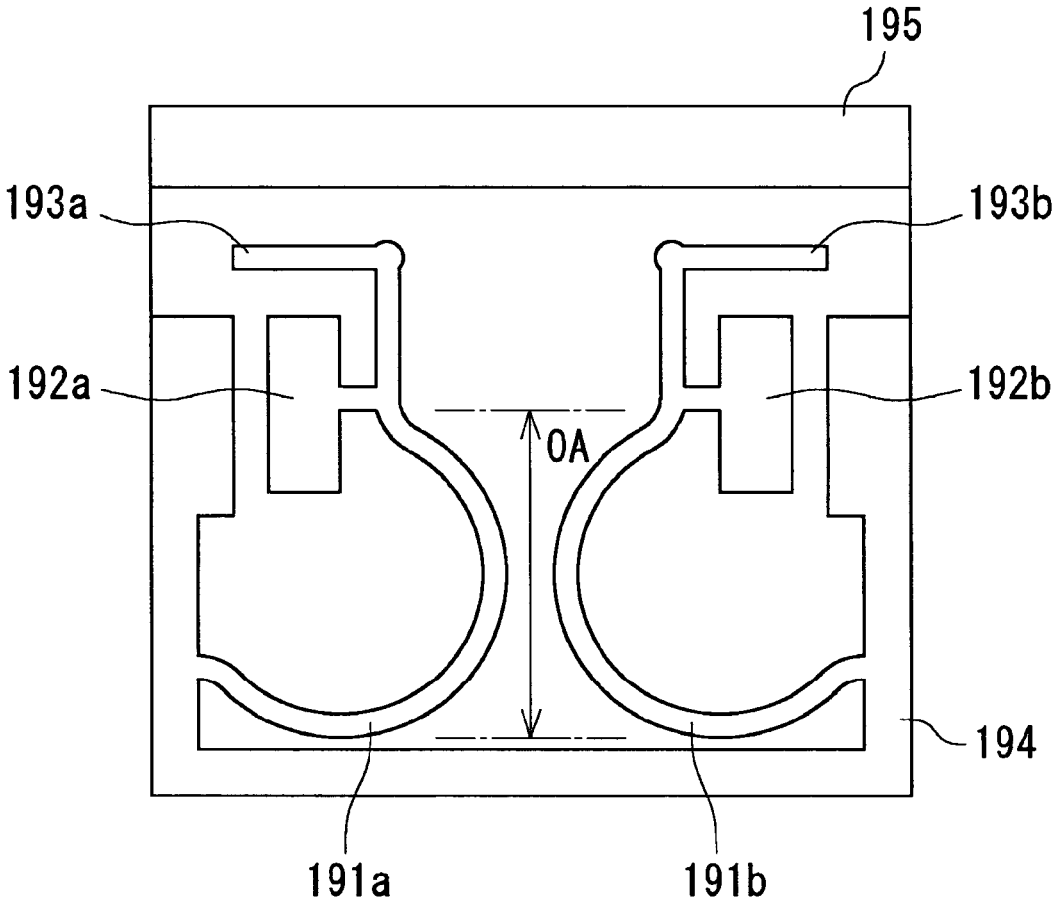
FIG. 6 is a diagram showing another configuration of the dielectric filter.

Further, although in the above embodiment, two conductor layers have been used to form spiral-shaped resonant electrodes, further more conductor layers can be used to increase the number of turns, thereby further lowering the pass-band frequency. Further, in a case where one conductor layer is used to form resonant electrodes, the resonant electrodes 191*a* and 191*b* can be formed in a loop shape as shown in FIG. 6, thereby elongating a portion of the wiring lines (range OA shown in FIG. 6) along which they are opposed to each other. That is, a resonant frequency can be lowered than a case where the resonant electrodes are formed linearly.

It is to be noted that there is a correlation between a length of a resonant electrode wiring line and static capacitance of a capacitor, so that if the resonant electrode wiring line is reduced, a capacitor having larger static capacitance is required. Therefore, by using a capacitor having large static capacitance with respect to its occupation area on the substrate, the dielectric filter can be miniaturized further.

Figure 7:
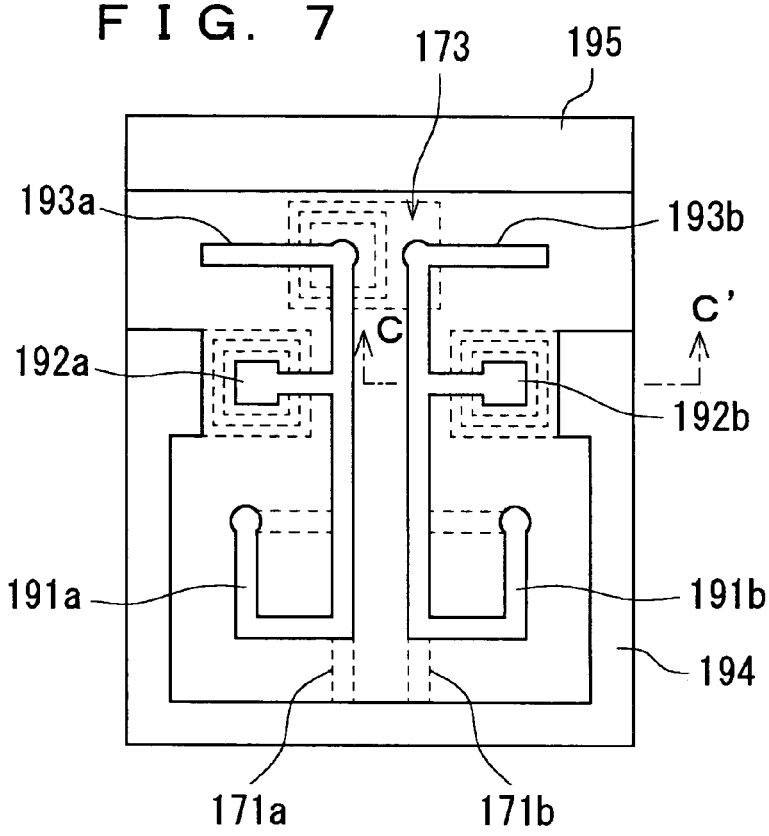
FIG. 7 is a diagram showing still another configuration of the dielectric filter.
Figure 8:
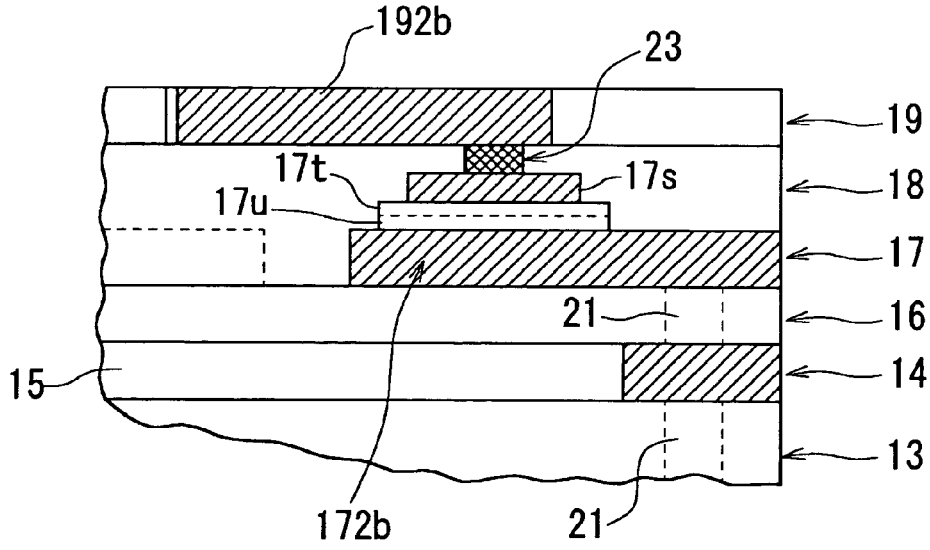
FIG. 8 is an outlined fragmentary cross-sectional view of a portion of a tantalum oxide capacitor.

The following will describe a case where a capacitor is used which has larger static capacitance with respect to the occupation area than the capacitor utilizing the fourth dielectric layer 18. FIG. 7 shows further another configuration of the dielectric filter, in which as the capacitor a tantalum oxide capacitor using, for example, tantalum oxide ($Ta_2O_5$) as its dielectric is employed. FIG. 8 is an outlined partially cross-sectional view (taken along line C–C' of FIG. 7) of a portion of the tantalum oxide capacitor.

In the tantalum oxide capacitor, a tantalum nitride (TaN) film 17*u* is formed on the capacitor electrodes 172*a*, 172*b*, and 173, each of which provides one capacitor. The tantalum nitride film 17*u* can be formed by chemical vapor deposition (CVD), sputtering, evaporation, etc. A surface layer of this tantalum nitride film 17*u* is anodized to provide a tantalum oxide film ($Ta_2O_5$) film 17*t*, which has a high dielectric constant and a low loss. Furthermore, on the tantalum oxide film, a wiring line film 17*s* which provides the other electrode of the tantalum oxide capacitor is formed and connected to the capacitor electrodes 192*a* and 192*b* and the resonant electrode 191*b*. The wiring line film can be connected to the capacitor electrodes 192*a* and 192*b* and the resonant electrode 191*b* by providing a via 23 to connect the wiring line film to the capacitor electrodes 192*a* and 192*b* and the resonant electrode 191*b* when, for example, forming the above-mentioned fourth dielectric layer 18 after the wiring line film is formed and forming the vias 20 and 21 in this fourth dielectric layer 18.

If the tantalum oxide capacitor is used in such a manner, as compared to a case where the capacitor is formed utilizing the fourth dielectric layer 18, an occupation area required to obtain the same static capacitance can be reduced, thus miniaturizing the dielectric filter. Furthermore, the capacitor, when used in a high-frequency region, self-resonates due to residual inductance caused by the electrode pattern etc., thus stopping functioning as a capacitor. Therefore, by setting a self-resonating frequency higher than the pass-band, a blocking level at frequencies higher than the pass-band can be increased.

Further, although in the dielectric filters shown in FIGS. 1, 6, and 7 respectively, the capacitor electrodes 192*a* and 192*b* have been connected somewhere along the resonant electrodes 191*a* and 191*b* respectively, the capacitor electrode 192*a* may be connected to the signal input terminal 193*a*, which is the open-end side of the resonant electrode 191*a*, and the capacitor electrode 192*b* may be connected to the signal output terminal 193*b*, which is the open-end side of the resonant electrode 191*b*. In this case, an electromagnetic field owing to this connection of the capacitor electrode has no influence on the parallel portion of the electrode, thereby facilitating design of the dielectric filter. Further, there is no influence of an electromagnetic field due to connection of the capacitor electrode to the parallel portion of the electrode, thereby utilizing the resonant electrodes effectively.

Furthermore, although in the above embodiment, the first conductor layer 12 which is one surface side of the resonant electrodes 171*a*, 171*b*, 191*a* and 191*b* has been used as the grounding conductor layer, as in the case of a strip-line, another grounding conductor layer may be provided also on the other side of the electrodes 171*a*, 171*b*, 191*a* and 191*b* via a dielectric layer, thereby containing an electromagnetic field in the stack substrate in construction.

The resonant electrodes have thus been formed in a loop shape or in a spiral shape in the substrate stacking direction so as to be symmetrical to each other, so that a wiring line portion along which the resonant electrodes are opposed to each other is elongated. Therefore, the dielectric filter can be miniaturized even if a pass-band frequency is low. Further, by forming the slot in such a manner as to contain a region that faces the resonant electrodes, it is possible to avoid any other signal wiring line pattern etc. from being arranged in the grounding electrode and the resonant electrodes, thereby obtaining a small-sized dielectric filter having desired filter characteristics. Further, since the slot portion is made of an insulating material having a high dielectric constant to constitute the second dielectric layer 15, the length of the wiring lines of the resonant electrodes can be reduced owing to a wavelength reduction effect.

Furthermore, by using the thin-film patterning technology, a wiring line of the resonant electrodes and an interval between the resonant electrodes can be reduced to strengthen electromagnetic coupling, thereby suppressing losses, improving accuracy thereof, and thinning the filter. Further, the capacitors are incorporated, so that as compared to a case where externally mounted capacitors are used, it is possible to suppress parasitic capacitance etc. and reduce the number of externally mounted components, thereby reducing the size and costs.

Figure 9:
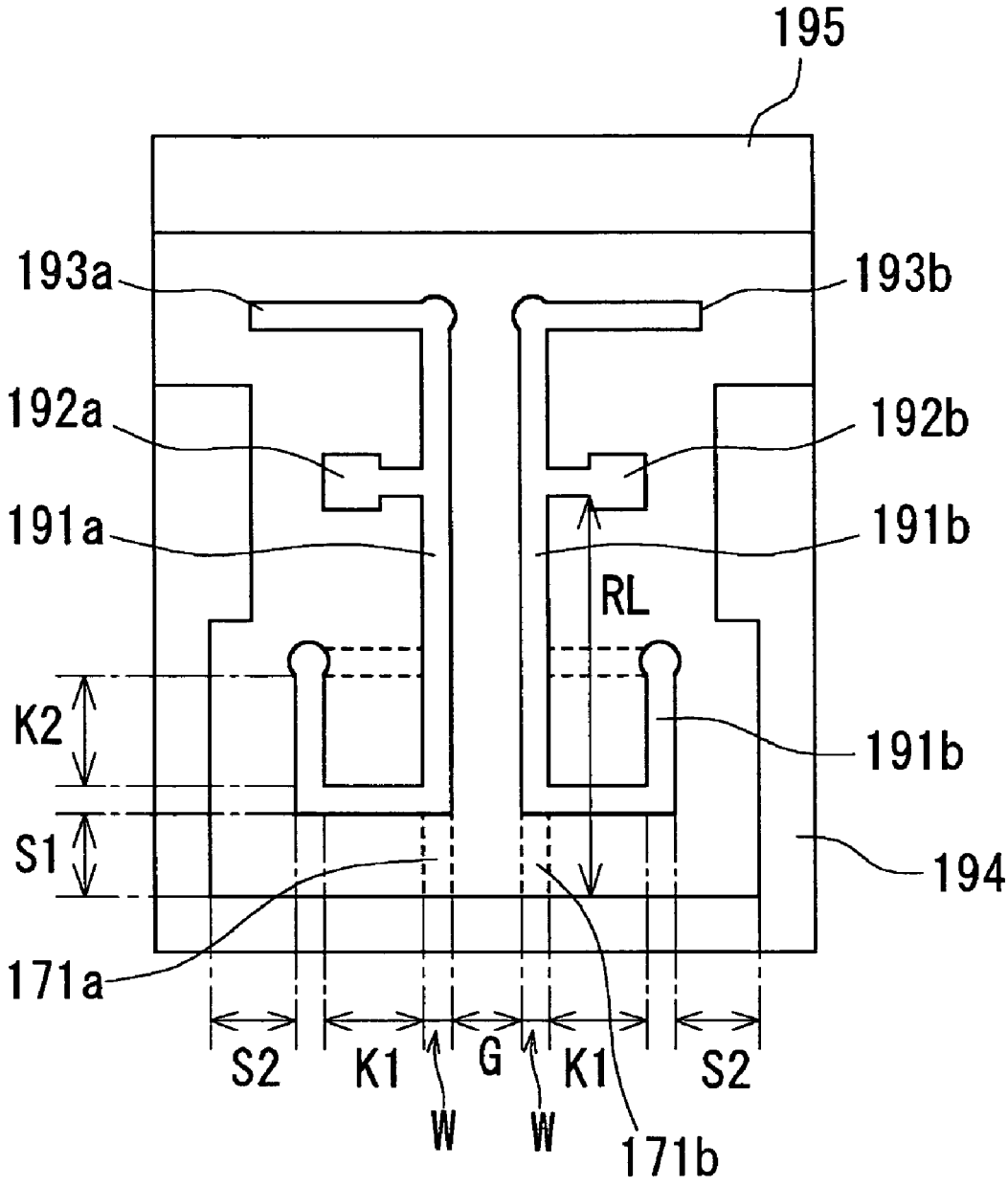
FIG. 9 is a diagram showing an implementation embodiment of the dielectric filter.

FIG. 9 shows another embodiment of the dielectric filter. If it is supposed that a wiring line length RL of the resonant electrodes is 600 μm, a wiring line length K1 is 150 μm, a wiring length K2 is 200 μm, a wiring line width W of the resonant electrodes is 50 μm, a space between the resonant electrodes is 130 μm, spacing items S1 and S2 between the resonant electrodes and an edge of the slot region are 200 μm, static capacitance of the capacitors C1 and C2 are 4.6 pF, and static capacitance of the capacitor C3 is 3.7 pF, transmission characteristics of the dielectric filter will be such as indicated by a solid line in FIG. 10 and its reflection characteristics will be such as indicated by a solid line in FIG. 11. It is to be noted that broken lines shown in FIGS. 10 and 11 indicate the characteristics in a case where the resonant electrodes are formed linearly to be connected to the grounding electrode and the spacing S2 between the resonant electrodes and the edge of the slot region is supposed to be 200 μm.

Figure 10:
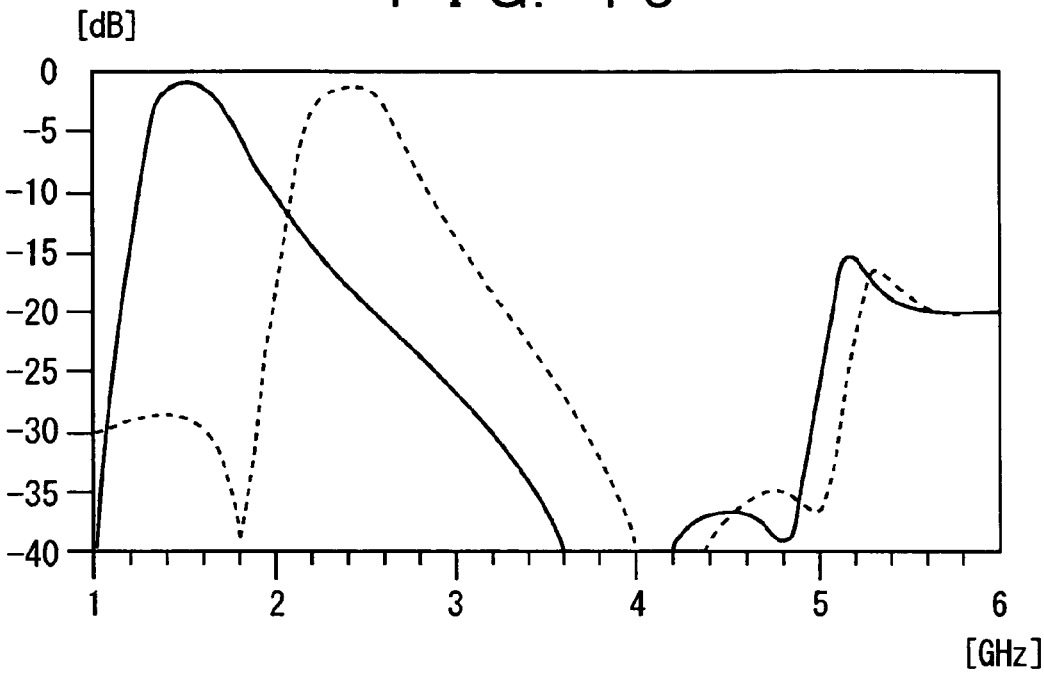
FIG. 10 is a diagram showing transmission characteristics of the embodiment.
Figure 11:
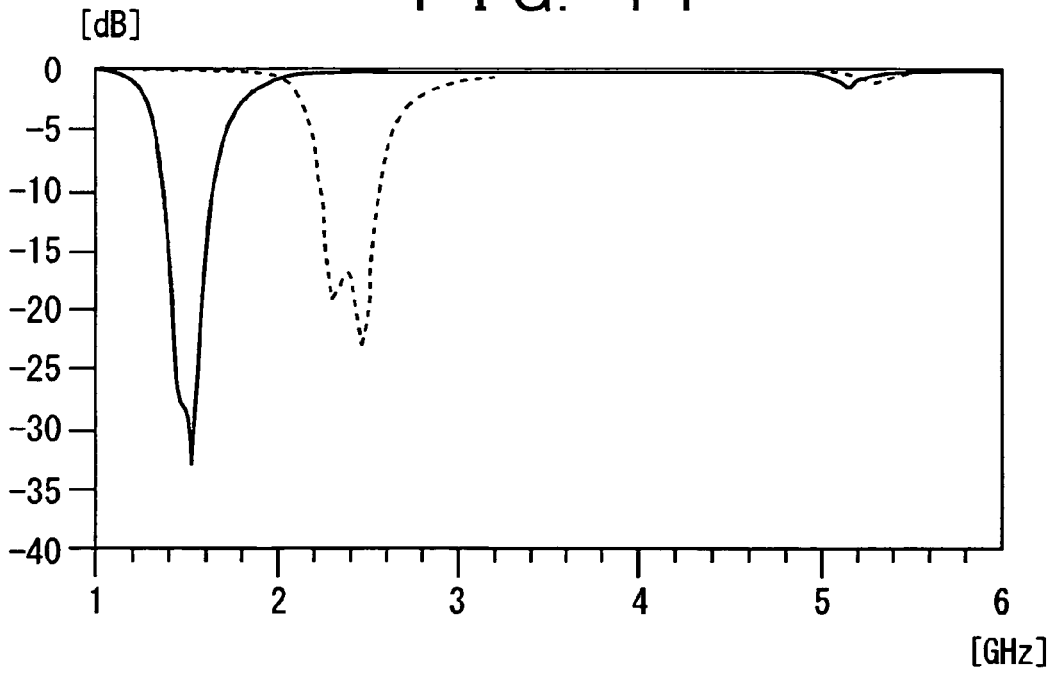
FIG. 11 is a diagram showing reflection characteristics of the embodiment.

As shown in FIG. 9, by forming the resonant electrodes in a spiral shape in the substrate stacking direction and elongating the portion along which they are opposed to each other, a pass-band frequency can be reduced. That is, without increasing the size of the dielectric filter, the pass-band frequency can be reduced from 2.5 GHz to about 1.5 GHz as shown in FIG. 10. The loss can also be reduced. Further, as shown in FIG. 11, reflection can also be suppressed.

As described above, a resonator and a dielectric filter related to the present invention are useful in transmitting a signal having a desired frequency of high-frequency signals in a microwave-band, a millimeter-wave band, etc. and well applied to a cellular phone or a portable instrument using a high-frequency signal in a wireless LAN, GPS, etc.

While the foregoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A resonator comprising a stack substrate obtained by stacking dielectric layers and conductor layers, said stack substrate including:

a grounding conductor layer formed on one end of said stack substrate; and a resonant-pattern conductor formed in a plurality of conductor layers in a stacking direction and having one pair of resonant electrodes each having one end as a short-circuiting end connected to the grounding conductor layer and the other end as an open end, the resonant-pattern conductor being provided opposite the grounding conductor layer via at least one dielectric layer, and wherein the open-end side of one of the resonant electrodes is a signal input terminal and the open-end side of the other one of the resonant electrodes is a signal output terminal, and wherein the pair of resonant electrodes are formed symmetrically in any one of a loop shape and a spiral shape across said plurality of conductor layers in the stacking direction.

2. The resonator according to claim 1, further comprising:

a first capacitor having a stack construction wherein one end thereof is connected to the grounding conductor layer and the other end thereof is connected to any one of the signal input terminal and a portion of the resonant electrode electrically connected to the signal input terminal; and a second capacitor having a stack construction wherein one end thereof is connected to the grounding conductor layer and the other end thereof is connected to any one of the signal output terminal and a portion of the resonant electrode electrically connected to the signal output terminal.

3. The resonator according to claim 2, wherein the first and second capacitors use tantalum oxide as dielectric material.

4. The resonator according to claim 1, wherein each conductor layer arranged between the grounding conductor layer and the resonant-pattern conductor has an area void of conductive material at a region which faces the resonant pattern conductor.

5. A dielectric filter for allowing, within a signal input to a signal input terminal, a desired frequency band to be transmitted and output from a signal output terminal, said dielectric filter comprising a stack substrate obtained by stacking dielectric layers and conductive layers, said stack substrate including:

a grounding conductor layer formed on one end of said stack substrate; and a resonant-pattern conductor formed in a plurality of conductor layers in a stacking direction and having one pair of resonant electrodes each having one end as a short-circuiting end connected to the grounding conductor layer and the other end as an open end, the resonant-pattern conductor being provided opposite the grounding conductor layer via at least one dielectric layer, and wherein the open-end side of one of the resonant electrodes is the signal input terminal and the open-end side of the other one of the resonant electrodes is the signal output terminal, and wherein the pair of resonant electrodes are formed symmetrically in any one of a loop shape and a spiral shape across said plurality of conductor layers in the stacking direction.

6. The dielectric filter according to claim 5, further comprising:

a first capacitor having a stack construction wherein one end thereof is connected to the grounding conductor layer and the other end thereof is connected to the signal input terminal; and a second capacitor having a stack construction wherein one end thereof is connected to the grounding conductor layer and the other end thereof is connected to the signal output terminal.

7. The dielectric filter according to claim 6, further comprising a third capacitor having a stack construction wherein one end thereof is connected to the signal input terminal of the resonant electrode and the other end thereof is connected to the signal output terminal of the resonant electrode.

8. The dielectric filter according to claim 7, wherein the first through third capacitors use tantalum oxide as dielectric material.

9. The dielectric filter according to claim 5, wherein each conductive layer arranged between the grounding conductor layer and the resonant-pattern conductor includes an area void of conductive material at a region which faces the resonant pattern conductor.

10. The resonator according to claim 1, wherein said resonant-pattern comprises an L-shaped conductor formed in one layer, and a U-shaped conductor formed in an adjacent layer.

11. The dielectric filter according to claim 5, wherein said resonant-pattern comprises an L-shaped conductor formed in one layer, and a U-shaped conductor formed in an adjacent layer.

* * * * *